US007639270B2

(12) United States Patent
Chen

(10) Patent No.: US 7,639,270 B2
(45) Date of Patent: Dec. 29, 2009

(54) OBJECT MOVING APPARATUS

(75) Inventor: Tsung-Yueh Chen, Taipei (TW)

(73) Assignee: HiTi Digital, Inc., Taipei (TW)

( * ) Notice: Subject to any disclaimer, the term of this patent is extended or adjusted under 35 U.S.C. 154(b) by 0 days.

(21) Appl. No.: 12/060,858

(22) Filed: Apr. 1, 2008

(65) Prior Publication Data

US 2009/0086007 A1 Apr. 2, 2009

(30) Foreign Application Priority Data

Sep. 29, 2007 (TW) ..... 96136540 A

(51) Int. Cl.
*B41J 2/32* (2006.01)
*B41J 13/00* (2006.01)

(52) U.S. Cl. ..... 347/218

(58) Field of Classification Search ..... 347/218, 347/154, 104, 164, 262, 264
See application file for complete search history.

(56) References Cited

U.S. PATENT DOCUMENTS 5,474,394 A 12/1995 Koike et al.
5,988,907 A 11/1999 Iso
6,545,694 B1 4/2003 Yamaguchi

FOREIGN PATENT DOCUMENTS

JP 2006-001688 * 1/2006

OTHER PUBLICATIONS

Computer-generated translation of JP 2006-001688 dated Jan. 2006.*

* cited by examiner

*Primary Examiner*—Huan H Tran
(74) *Attorney, Agent, or Firm*—Winston Hsu

(57) ABSTRACT

An object moving apparatus for controlling the movement of an object such as a print medium includes a first motor, a second motor, a moving module, a first power transmission module, a second power transmission module and a controlling module. The moving module is for moving the object. The first power transmission module is coupled between the first motor and the moving module, and is for delivering power from the first motor to the moving module to drive the moving module to move the object. The second power transmission module is coupled between the second motor and the moving module, and is for delivering power from the second motor to the moving module to drive the moving module to move the object. The controlling module is coupled to the first and second motors, and is for selectively turning on the first motor or the second motor.

8 Claims, 2 Drawing Sheets

OBJECT MOVING APPARATUS

BACKGROUND OF THE INVENTION

1. Field of the Invention

The present invention relates to an object moving apparatus, and more particularly, to an object moving apparatus having a first motor, a second motor, a moving module and a controlling module. The controlling module selectively turns on the first motor or the second motor to drive the moving module.

2. Description of the Prior Art

In general, color printers can be classified into four major types: dot matrix printers, inkjet printers, laser printers and dye diffusion thermal printers. The dye diffusion thermal printer utilizes a thermal print head to heat ribbons containing dyes in order to transfer the dyes onto an object to be printed. In this way, continuous-tone can be formed on the object according to the heating time or the heating temperature. Due to its excellent printing quality and the natural, continuous color expression, the thermal printer is particularly suitable for photo printing applications.

In general, the dye diffusion thermal printer is capable of operating under a printing mode or a paper-moving mode since the dyes in respective ribbons with respective colors are transferred onto the object to be printed (e.g., paper). While operating under the printing mode, the dye diffusion thermal printer motor moves the object from an initial position to transfer dye of one specific color on the ribbon onto the object. Next, the dye diffusion thermal printer is switched to operate under the paper-moving mode. Under the paper-moving mode, the motor moves the object back to the initial position so as to transfer the dye of another specific color on the ribbon onto the object.

Please refer to FIG. 1. FIG. 1 is a diagram illustrating a typical dye diffusion thermal printer 100. As shown in FIG. 1, the dye diffusion thermal printer 100 comprises a stepping motor 110, an active pulley 122, a belt 124, a passive pulley 126, a capstan roller 132 and a pinch roller 134. The active pulley 122 is coupled to the stepping motor 110, the passive pulley 126 is coupled to the capstan roller 132, and the active pulley 122 and passive pulley 126 are coupled to each other via the belt 124. The power generated from the stepping motor 110 is therefore delivered to the capstan roller 132 through the active pulley 122, the belt 124 and the passive pulley 126 in sequence for rotating the capstan roller 132. Both the capstan roller 132 and the pinch roller 134 are in contact with a print media 10 (e.g., a piece of paper or a card). When the capstan roller 132 rotates, the pinch roller 134 is driven to rotate simultaneously to move the print media 10 together. The moving direction of the print media 10 depends on the rotating direction of the capstan roller 132. Taking FIG. 1 for example, when the capstan roller 132 rotates counter-clockwise, the print media 10 is moved to the right (printing/paper-moving mode); otherwise, when the capstan roller 132 rotates clockwise, the print media 10 is moved to the left (paper-moving/printing mode).

To ensure a good print quality, the motor operating under the printing mode is expected to output with a high torque, and the motor operating under the paper-moving mode is expected to output at high speed. There is a fundamental trade-off, however, between torque and speed while the driving voltage is on the fixed level. More specifically, the motor can either output with a high torque but low speed or output with a high speed but low torque. As mentioned above, the prior art only uses one stepping motor to drive the capstan roller for rotating. With the traditional method, in order to make the stepping motor output with a high torque and high speed, high voltage or high current is required to drive the stepping motor. This method consumes high power, however. In addition, the volume of the stepping motor is also increased for the purpose of providing high speed and high torque. Furthermore, the temperature of the motor will get extremely high since the motor operates at the high power mode continuously.

SUMMARY OF THE INVENTION

It is therefore one of the objectives of the present invention to provide an object moving apparatus having two motors that is capable of adjusting the parameters of the motors according to the required angular velocity and torsion.

According to an exemplary embodiment of the present invention, an object moving apparatus is disclosed. The object moving apparatus comprises: a first motor; a second motor; a moving module, for moving the object; a first power transmission module, coupled between the first motor and the moving module, for delivering power from the first motor to the moving module to drive the moving module to move the object; a second power transmission module, coupled between the second motor and the moving module, for delivering power from the second motor to the moving module to drive the moving module to move the object; and a controlling module, coupled to the first and second motors, for selectively turning on the first motor or the second motor.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
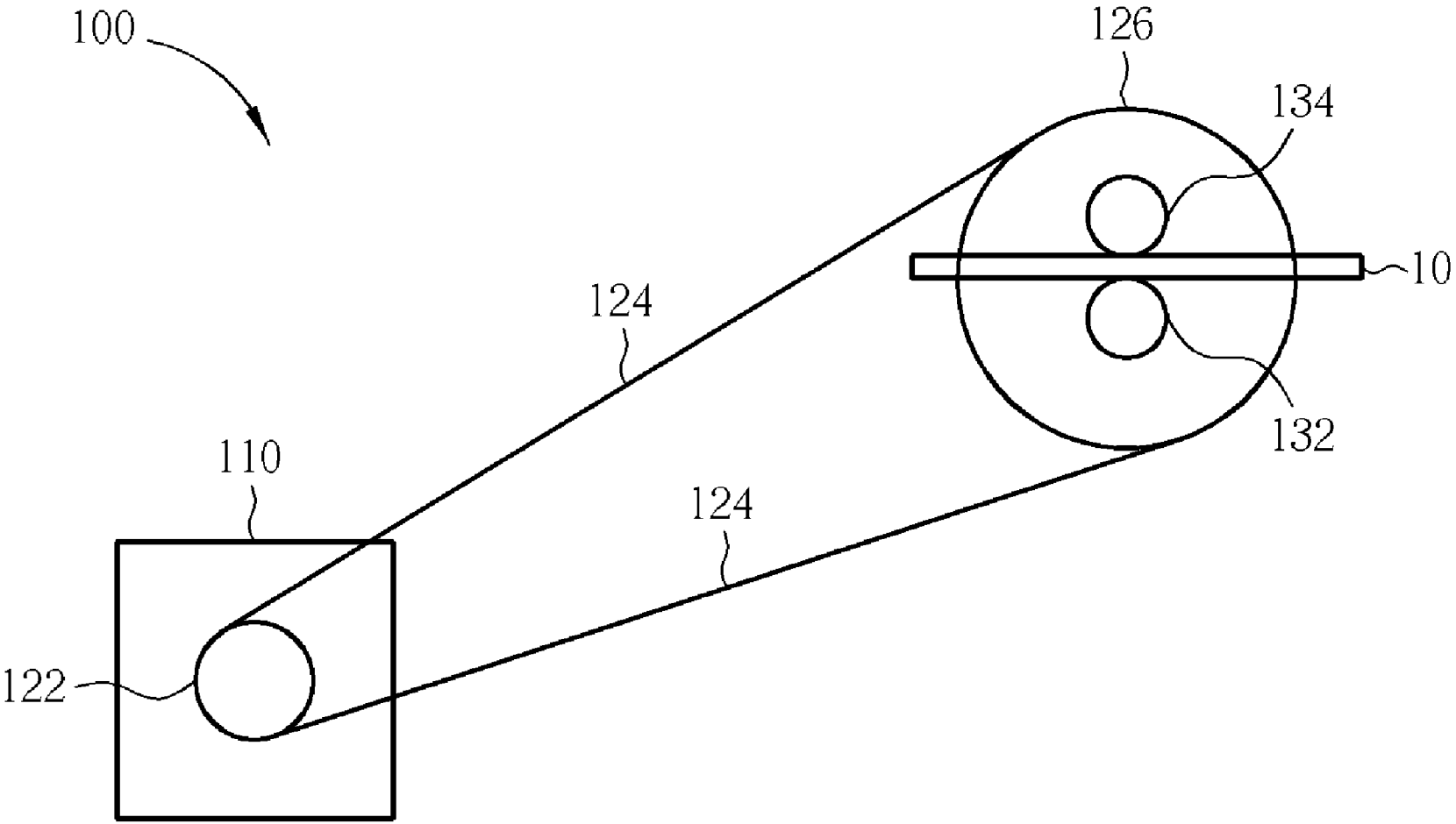
FIG. 1 PRIOR ART
FIG. 1 is a diagram illustrating a typical dye diffusion thermal printer.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ".

Different features of the present invention are detailed as below with reference to the figures, and for convenience of explanation, the same elements in different figures have the same reference numerals.

Figure 2:
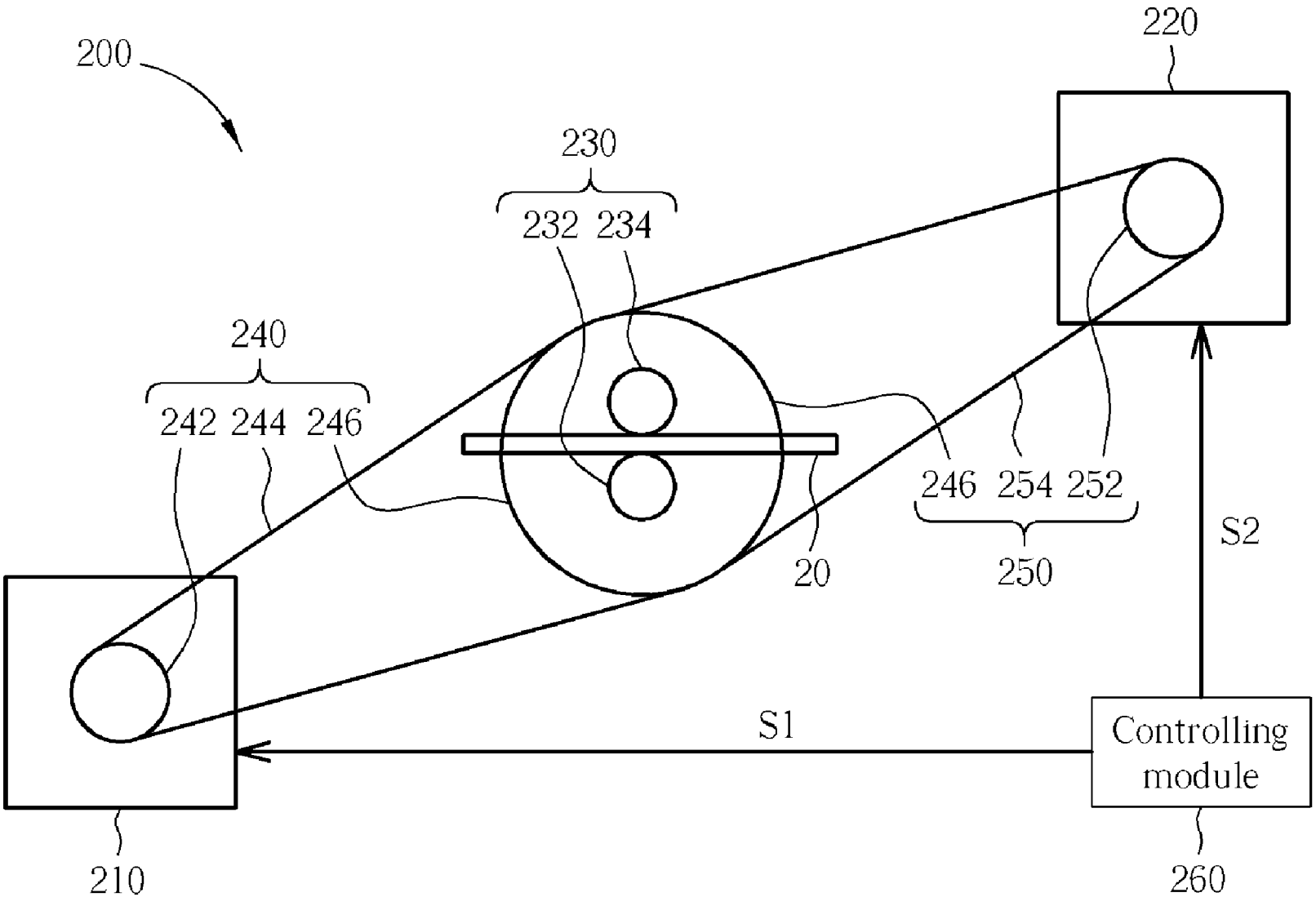
FIG. 2 is a simplified diagram illustrating an object moving apparatus for controlling the movement of an object.

Please refer to FIG. 2. FIG. 2 is a simplified diagram illustrating an object moving apparatus 200 for controlling the movement of an object 20. As shown in FIG. 2, the object moving apparatus 200 comprises a first motor 210, a second motor 220, a moving module 230, a first power transmission module 240, a second power transmission module 250 and a controlling module 260. The moving module 230 is used for moving the object 20. The first power transmission module 240 is coupled between the first motor 210 and the moving module 230, and is used for delivering power from the first motor 210 to the moving module 230 to drive the moving module 230 to move the object 20. The second power transmission module 250 is coupled between the second motor 220 and the moving module 230, and is used for delivering power from the second motor 220 to the moving module 230 to drive the moving module 230 to move the object 20. The controlling module 260 is coupled to the first and second motors 210, 220, and is used for selectively turning on the first motor 210 or the second motor 220.

In this embodiment, the moving module 230 comprises a first roller 232 and a second roller 234; the first power transmission module 240 comprises a first active pulley 242, a first belt 244 and a passive pulley 246; the second power transmission module 250 comprises a second active pulley 252, a second belt 254 and the passive pulley 246. In the moving module 230, the first roller 232 is in contact with one side of the object 20, and is driven by the first power transmission module 240 or the second power transmission module 250 to rotate in order to move the object 20; the second roller 234 is in contact with another side of the object 20, and is used for moving the object 20 with the first roller 232. In the first power transmission module 240, the first active pulley 242 is coupled to the first motor 210 for receiving the power from the first motor 210; the passive pulley 246 is coupled to the first roller 232; and the first belt 244 is connected between the first active pulley 242 and the passive pulley 246 for delivering power from the first active pulley 242 to the passive pulley 246. Similarly, in the second power transmission module 250, the second active pulley 252 is coupled to the second motor 220 for receiving the power from the second motor 220; the passive pulley 246 is coupled to the first roller 232; and the second belt 254 is connected between the second active pulley 252 and the passive pulley 246 for delivering power from the second active pulley 252 to the passive pulley 246. In addition, in this embodiment, the object moving apparatus 200 is disposed in a dye diffusion thermal transfer printer, the object 20 is a print media, the first roller 232 is a capstan roller, the second roller 234 is a pinch roller, and both the first motor 210 and the second motor 220 are stepping motors. The further operations of the object moving apparatus 200 will be explained in the following. To make the concept of the present invention easily appreciable, a card taken as the print media (i.e., the object 20) is utilized in the following embodiment to illustrate the present invention; this is, however, for illustrative purposes and not a limitation of the prevent invention.

Please refer to FIG. 2 again. As can be seen from the diagram, the controlling module 260 transmits controlling signals S1 and S2 respectively to the first motor 210 and the second motor 220 for controlling the operation of the first and second motors 210, 220. When the dye diffusion thermal transfer printer operates under the printing mode, the controlling module 260 turns on the first motor 210 and turns off the second motor 220. The first roller 232 is therefore driven by the first motor 210 via the first power transmission module 240. When the dye diffusion thermal transfer printer operates under the paper-moving mode, the controlling module 260 turns on the second motor 220 and turns off the first motor 210. The first roller 232 is therefore driven by the second motor 220 via the second power transmission module 250.

Compared with the prior art, when the dye diffusion thermal transfer printer of the prevent invention operates under both a printing mode and a paper-moving mode, the first roller 232 can be driven by the first motor 210 or the second motor 220. In this way, the characteristic curve of torque to speed for the first motor 210 and the gear ratio of the first power transmission module 240 can be specially designed for the printing mode; the characteristic curve of torque to speed for the second motor 220 and the gear ratio of the second power transmission module 250 can be specially designed for the paper-moving mode. For example, the first motor 210 and the second motor 220 are respectively implemented by a motor with high inductance and a motor with low inductance and operate under appropriate gear rates. The first motor 210 accordingly outputs with high torque while the dye diffusion thermal transfer printer is operating under the printing mode, and the second motor 220 accordingly outputs with high speed while the dye diffusion thermal transfer printer is operating under the paper-moving mode. In this way, both good print quality and high print efficiency can be ensured. In addition, the second motor 220 is not required to be energized under the printing mode, and the first motor 210 is not required to be energized under the paper-moving mode. The temperature of the two motors will not get extremely high since neither the first motor 210 nor the second motor 220 operates continuously. Furthermore, high voltage or high current is also not required to be used to drive the motors for the purpose of providing high speed and high torque simultaneously, so the consumed power can be significantly decreased.

Please note that, although the first power transmission module 240 and the second power transmission module 250 share the passive pulley 246 in this embodiment, this is for illustrative purposes only and is not deemed to be a limitation of the present invention. For example, the first power transmission module 240 and the second power transmission module 250 can respectively comprise a passive pulley, which is coupled to the first roller 232. After reading the above-mentioned description, a corresponding operation of the object moving apparatus whose first and second power transmission modules 240 and 250 respectively comprise a passive pulley should be readily appreciated by those skilled in the art, so further description is omitted here for the sake of brevity.

Please note that both the first and second power transmission modules 240 and 250 are implemented by an active pulley, a belt and a passive pulley; this is, however, merely for illustrative purposes and is not deemed to be a limitation of the present invention. In other embodiments, the power transmission module can be implemented by a gear set depending on design requirements. Those skilled in the art should readily appreciate how to implement the power transmission module by a gear set, so further description is omitted here for the sake of brevity. Furthermore, that the moving module 230 comprises the first and second rollers 232, 234 is only for illustrative purposes, and is not a limitation of the prevent invention. Using any alternative mechanisms to achieve the objective to move the object 20 also falls within the scope of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An object moving apparatus, for controlling movement of an object, the object moving apparatus comprising:

a first motor;

a second motor;

a moving module, for moving the object;

a first power transmission module, coupled between the first motor and the moving module, for delivering power from the first motor to the moving module to drive the moving module to move the object;

a second power transmission module, coupled between the second motor and the moving module, for delivering power from the second motor to the moving module to drive the moving module to move the object; and a controlling module, coupled to the first and second motors, for selectively turning on the first motor or the second motor;

wherein the moving module comprises:

a first roller, being in contact with one side of the object, the first roller being driven by the first power transmission module or the second power transmission module to rotate in order to move the object; and a second roller, being in contact with the other side of the object.

2. The object moving apparatus of claim 1, being disposed in a printer, wherein the object is a print media, the first roller is a capstan roller and the second roller is a pinch roller.

3. The object moving apparatus of claim 2, wherein when the printer operates in a printing mode, the controlling module turns on the first motor to drive the first roller via the first power transmission module; and when the printer operates in a paper-moving mode, the controlling module turns on the second motor to drive the first roller via the second power transmission module.

4. The object moving apparatus of claim 3, wherein an inductance of the first motor is greater than an inductance of the second motor.

5. The object moving apparatus of claim 2, wherein the first power transmission module comprises:

a first active pulley, coupled to the first motor, for receiving the power from the first motor;

a first passive pulley, coupled to the first roller; and a first belt, connected between the first active pulley and the first passive pulley, for delivering power from the first active pulley to the first passive pulley; and the second power transmission comprises:

a second active pulley, coupled to the second motor, for receiving the power from the second motor;

a second passive pulley, coupled to the first roller; and a second belt, connected between the second active pulley and the second passive pulley, for delivering power from the second active pulley to the second passive pulley.

6. The object moving apparatus of claim 2, wherein the first power transmission module comprises:

a first active pulley, coupled to the first motor, for receiving the power from the first motor;

a passive pulley, coupled to the first roller; and a first belt, connected between the first active pulley and the passive pulley, for delivering power from the first active pulley to the passive pulley; and the second power transmission comprises:

a second active pulley, coupled to the second motor, for receiving the power from the second motor;

the passive pulley, coupled to the first roller; and a second belt, connected between the second active pulley and the passive pulley, for delivering power from the second active pulley to the passive pulley.

7. The object moving apparatus of claim 2, wherein both the first motor and the second motor are stepping motors.

8. The object moving apparatus of claim 2, wherein the printer is a dye diffusion thermal transfer printer.

* * * * *